US006014956A

United States Patent [19]

Cowden et al.

[11] Patent Number: 6,014,956

[45] **Date of Patent: *Jan. 18, 2000**

[54] ELECTRONIC CONTROL FOR A HYDRAULICALLY ACTIVATED, ELECTRONICALLY CONTROLLED INJECTOR FUEL SYSTEM AND METHOD FOR OPERATING SAME

[75] Inventors: Gary L. Cowden, Morton; Brian G. McGee, Chillicothe; Daniel R. Puckett, Peoria; John P. Timmons, Chillicothe, all of Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/996,278

[22] Filed: Dec. 22, 1997

[51] Int. Cl.[7] ..... F02M 37/04

[52] U.S. Cl. ..... 123/446; 123/381; 123/458

[58] Field of Search ..... 123/446, 447, 123/458, 381; 239/88–95; 251/129.01, 129.09

[56] References Cited

U.S. PATENT DOCUMENTS

| | | | |
|---|---|---|---|
| Re. 33,270 | 7/1990 | Beck et al. | 123/447 |
| 4,922,878 | 5/1990 | Shinogle et al. | 123/490 |
| 5,176,115 | 1/1993 | Campion | 123/179.17 |
| 5,181,494 | 1/1993 | Ausman et al. | 123/446 |
| 5,191,867 | 3/1993 | Glassey | 123/446 |
| 5,357,912 | 10/1994 | Barnes | 123/446 |
| 5,359,883 | 11/1994 | Baldwin et al. | 73/117.3 |
| 5,445,129 | 8/1995 | Barnes | 123/446 |
| 5,447,138 | 9/1995 | Barnes | 123/446 |
| 5,463,996 | 11/1995 | Maley et al. | 123/446 |
| 5,477,828 | 12/1995 | Barnes | 123/446 |
| 5,485,820 | 1/1996 | Iwaszkiewicz | 123/446 |
| 5,492,098 | 2/1996 | Hafner et al. | 123/446 |
| 5,492,099 | 2/1996 | Maddock | 123/446 |
| 5,517,972 | 5/1996 | Stockner | 123/496 |
| 5,564,391 | 10/1996 | Barnes | 123/446 |
| 5,566,660 | 10/1996 | Camplin et al. | 123/496 |
| 5,586,538 | 12/1996 | Barnes | 123/446 |
| 5,632,444 | 5/1997 | Camplin et al. | 239/88 |
| 5,651,345 | 7/1997 | Miller et al. | 123/446 |
| 5,669,355 | 9/1997 | Gibson et al. | 123/446 |
| 5,673,669 | 10/1997 | Maley et al. | 123/446 |
| 5,687,693 | 11/1997 | Chen et al. | 123/446 |
| 5,697,342 | 12/1997 | Anderson et al. | 123/446 |
| 5,717,562 | 2/1998 | Antone et al. | 361/155 |

*Primary Examiner*—Carl S. Miller

*Attorney, Agent, or Firm*—Byron G. Buck; David M. Masterson

[57] ABSTRACT

An apparatus and method for varying the duration of current levels of a fuel injection signal used in connection with an electronically controlled hydraulic actuator unit injector fuel system is disclosed. The apparatus and method varies the duration of the pull-in current of the fuel injection signal delivered to the unit injector based on sensed engine parameters, which preferably include a sensed temperature of the engine and engine speed.

9 Claims, 4 Drawing Sheets

110
122
127
S1
180
25
112
132
S2
138
185
136
127
S9
S1
S2
S3
S4
S5
S6
S7
S8
111
S10
140
174
130
128
114
114
120
144
126
133
148
146
124
147
149
144
116
142
118

ELECTRONIC CONTROL FOR A HYDRAULICALLY ACTIVATED, ELECTRONICALLY CONTROLLED INJECTOR FUEL SYSTEM AND METHOD FOR OPERATING SAME

DESCRIPTION

1. Technical Field

The present invention relates generally to hydraulically actuated electronically controlled fuel injection, and more particularly, to an electronic control for varying the duration time of current levels of a fuel injection signal based on sensed engine parameters.

2. Background Art

Electronically controlled fuel injectors are well known in the art. An example of a hydraulically actuated electronically controlled unit injector fuel system is shown in U.S. Pat. No. 5,191,867 issued to Glassey on Mar. 9, 1993.

As is known in the art, to control the power and emissions output of an internal combustion engine precisely, it is necessary to control the timing and quantity of fuel injected into the engine cylinders. Electronically controlled fuel injectors typically inject fuel into a specific engine cylinder as a function of an injection signal received from an electronic controller. When using hydraulically actuated electronically controlled unit injectors (hereinafter referred to as "HEUI injectors"), the injection signal includes generally a two-tier current waveform that includes a pull-in current level and a generally lower hold-in current level. An example of such a fuel injection signal is disclosed in U.S. Pat. No. 5,564,391 issued to Barnes et al. The higher pull-in current is used to quickly open the fuel injector and thereby decrease the response time (i.e., the time between the initiation of a fuel injection signal and the time at which fuel actually begins to enter the engine cylinder). Once fuel injection has commenced, a lower level hold-in current can be used to hold the injector open for the remainder of the injection cycle.

In general, it is desirable to decrease the response time of the injector. Higher pull-in current level will generally decrease the response time. However, current levels that are too high for too long will result in undesirable consequences. For example, when the pull-in current level is held too high for too long, the fuel injector solenoid must be able to withstand the higher power levels and the driver circuit electrical components must be able to provide and dissipate the greater heat. As is described in more detail below, higher current levels for too long of a duration can also create undue stress on mechanical components of the injector and also degrade its repeatability. Higher power components and/or more robust mechanical components will increase the cost of the injector driver design. The degradation of the injector repeatability will adversely affect injector performance.

Additionally, it is desirable to maintain the pull-in current for a duration long enough to hold the ball to the high pressure seat of the injector. If the ball is not held to the high pressure seat, then the injection event will not be consistent and could inconsistently fuel the engine.

Typically, the pull-in current duration time is a pre-selected value that provides pull-in current for a sufficient length of time to provide acceptable injection response under the most severe injector operating condition (e.g. low temperature cold starting). However, that pre-selected pull-in current duration time may be longer than is required to provide the desired response in other, less severe, operating conditions. Therefore, it would be desirable to have a method and apparatus capable of varying the pull-in current duration time as the injector operating conditions transition between severe and less severe conditions. Additionally, it would be preferable to have a system capable of providing a desired response time without requiring higher power components and without unduly stressing the mechanical components.

The present invention is directed to overcoming one or more of the problems as set forth above.

DISCLOSURE OF THE INVENTION

The present invention includes an electronic control system used in connection with a compression ignition engine. The engine has a hydraulically actuated electronic unit fuel injector. Included is an electronic controller connected to the fuel injector. An engine temperature sensor is used to produce a signal responsive to a temperature of the engine. The electronic controller produces a fuel injection signal that is, in part, a function of the signal responsive to a temperature of the engine.

These and other aspects and advantages of the present invention will become apparent upon reading the detailed description in connection with the drawings and appended claims.

BRIEF DESCRIPTION OF THE DRAWINGS

For a better understanding of the invention, reference may be made to the accompanying drawings, in which.

DETAILED DESCRIPTION OF THE BEST MODE FOR CARRYING OUT THE INVENTION

Figure 1:
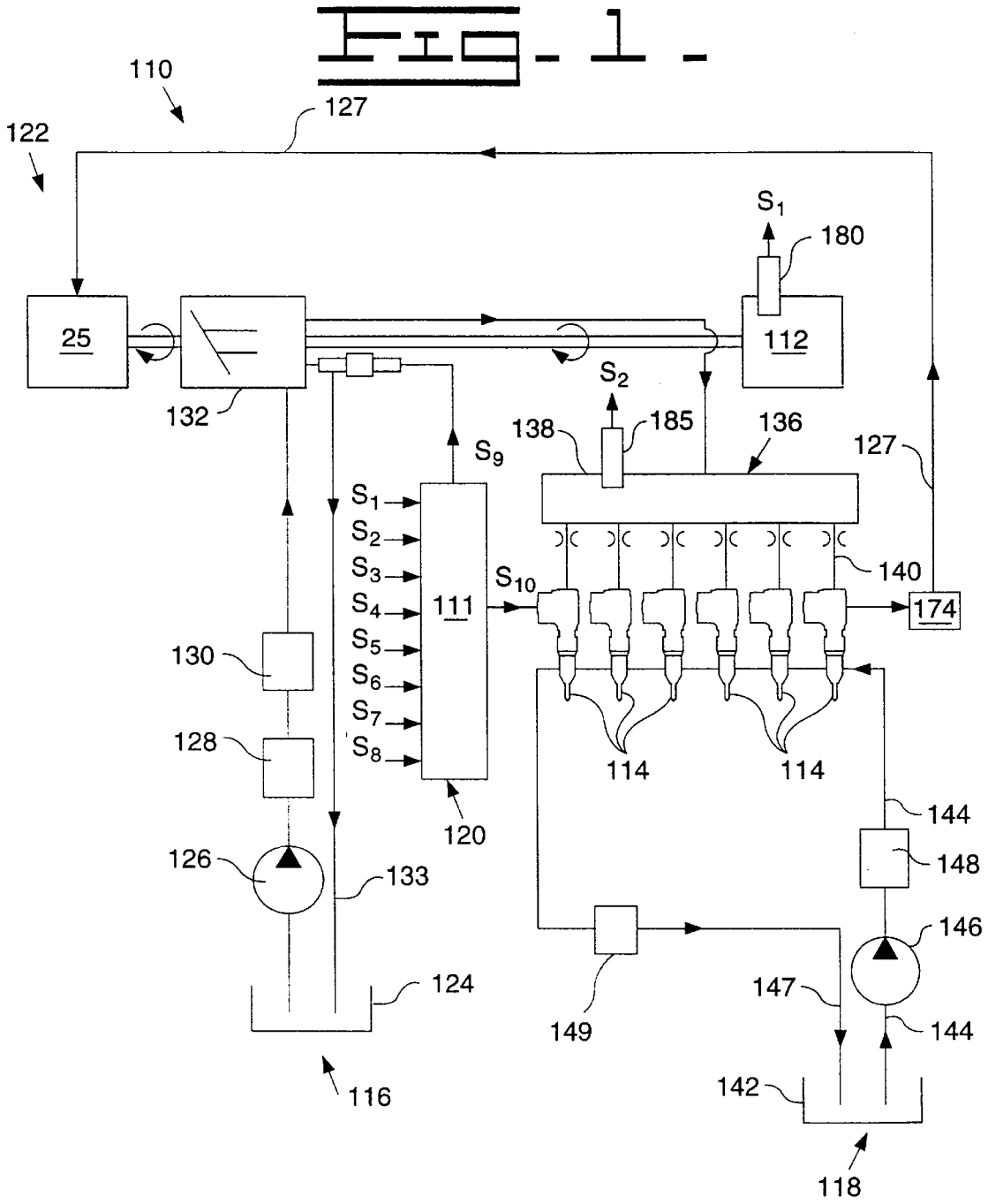
FIG. 1 is a schematic view of a fuel injection system used in connection with a preferred embodiment of the invention.

Referring now to FIG. 1, there is shown an embodiment of a hydraulically-actuated electronically-controlled fuel injection system 110 in an example configuration as adapted for a direct-injection diesel-cycle internal combustion engine 112. Fuel system 110 includes one or more hydraulically-actuated electronically-controlled fuel injectors 114, which are adapted to be positioned in a respective cylinder head bore of engine 112. Fuel system 110 includes an apparatus or means 116 for supplying actuation fluid to each injector 114, an apparatus or means 118 for supplying fuel to each injector, a computer 120 for electronically controlling the fuel injection system and an apparatus or means 122 for re-circulating actuation fluid and for recovering hydraulic energy from the actuation fluid leaving each of the injectors.

The actuating fluid supply means 116 preferably includes an actuating fluid sump 124, a relatively low pressure actuating fluid transfer pump 126, an actuating fluid cooler 128, one or more actuation fluid filters 130, a high pressure pump 132 for generating relatively high pressure in the actuation fluid and at least one relatively high pressure actuation fluid manifold 136. A common rail passage 138 is arranged in fluid communication with the outlet from the relatively high pressure actuation fluid pump 132. A rail branch passage 140 connects the actuation fluid inlet of each injector 114 to the high pressure common rail passage 138.

Actuation fluid leaving an actuation fluid drain of each injector 114 enters a re-circulation line 127 that carries the same to the hydraulic energy re-circulating or recovering means 122. A portion of the re-circulated actuation fluid is channeled to high pressure actuation fluid pump 132 and another portion is returned to actuation fluid sump 124 via re-circulation line 133.

In a preferred embodiment, the actuation fluid is engine lubricating oil and the actuation fluid sump 124 is an engine lubrication oil sump. This allows the fuel injection system to be connected as a parasitic subsystem to the engine's lubricating oil circulation system.

The fuel supply means 118 preferably includes a fuel tank 142, a fuel supply passage 144 arranged in fluid communication between fuel tank 142 and the fuel inlet of each injector 114, a relatively low pressure fuel transfer pump 146, one or more fuel filters 48, a fuel supply regulating valve 149, and a fuel circulation and return passage 147 arranged in fluid communication between injectors 114 and fuel tank 142.

The computer 120 preferably includes an electronic control module 111 including a microprocessor and memory. As is known to those skilled in the art, the memory is connected to the microprocessor and stores an instruction set and variables. Associated with the microprocessor and part of the electronic control module 111 are various other known circuits such as power supply circuitry, signal conditioning circuitry and solenoid driver circuitry, among others. The electronic control module 111 controls 1) the fuel injection timing; 2) the total fuel injection quantity during an injection cycle; 3) the fuel injection pressure; 4) the number of separate injections or injection segments during each injection cycle; 5) the time intervals between the injection segments; 6) the time duration of the injection segments; 7) the fuel quantity of each injection segment during an injection cycle; 8) the actuation fluid pressure; 9) current level of the injector waveform; and 10) any combination of the above parameters. Computer 120 receives a plurality of sensor input signals $S_1$–$S_8$, which correspond to known sensor inputs, such as engine operating conditions including engine speed, engine temperature, pressure of the actuation fluid, etc., that are used to determine the precise combination of injection parameters for a subsequent injection cycle.

For example, an engine temperature sensor 180 is shown connected to the engine 112. In one embodiment, the engine temperature sensor includes an engine oil temperature sensor. However, an engine coolant temperature sensor can also be used to detect the engine temperature. The engine temperature sensor produces a signal designated by $S_1$ in FIG. 1 and is input to the computer 120 over line $S_1$.

In this example, computer 120 issues control signal $S_9$ to control the actuation fluid pressure and a fuel injection signal $S_{10}$ to energize a solenoid within a fuel injector thereby controlling fluid control valve(s) within each injector 114 and causing fuel to be injected into a corresponding engine cylinder. Each of the injection parameters are variably controllable, independent of engine speed and load. In the case of injector 114, control signal $S_{10}$ is a fuel injection signal that is a computer commanded current to the injector solenoid.

Figure 2:
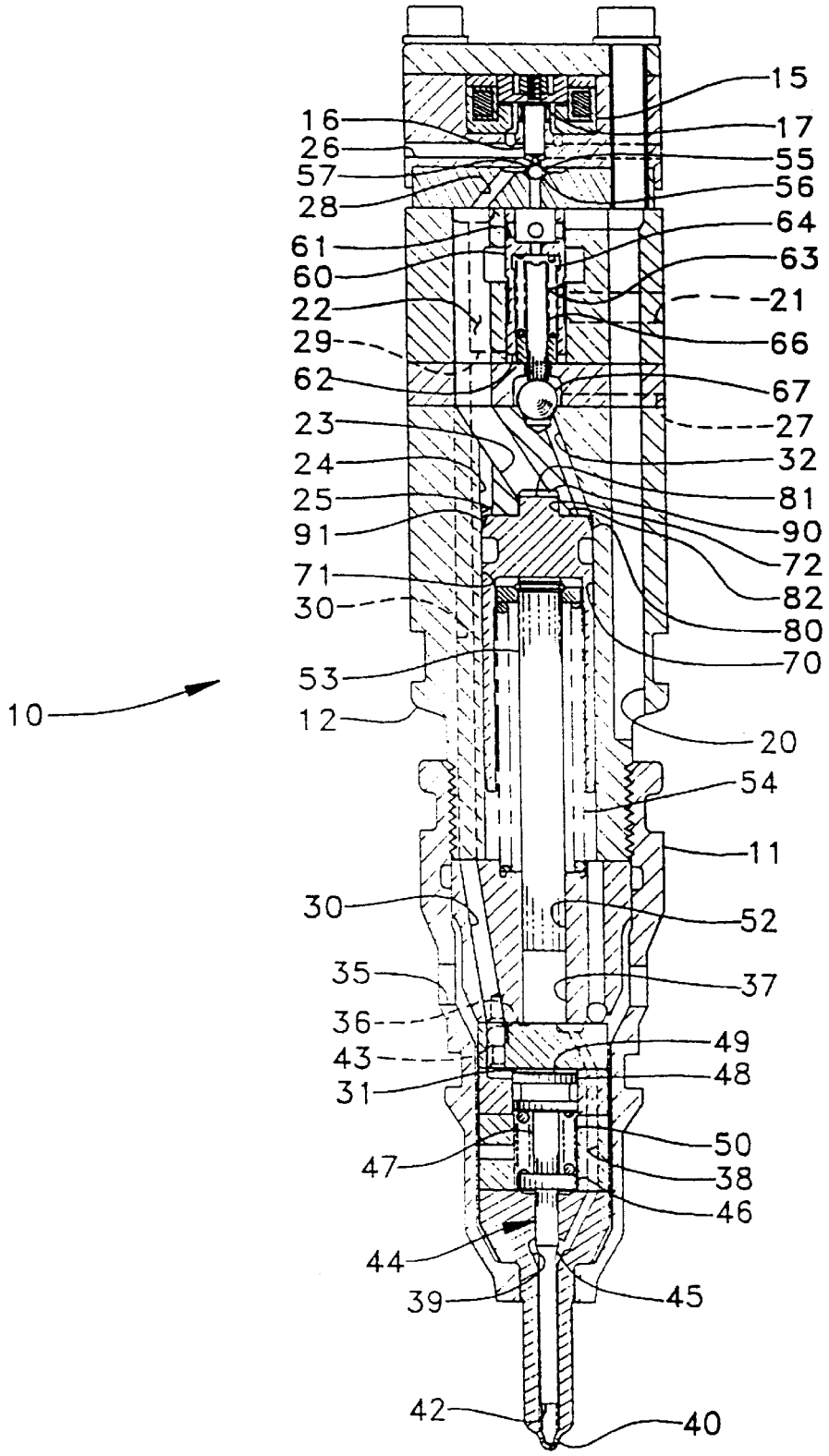
FIG. 2 is a sectioned side elevational view of a preferred embodiment of a hydraulically-actuated fuel injector used in connection with the present invention.

Referring now to FIG. 2, a sectioned side elevational view of a preferred embodiment of a HEUI fuel injector used in connection with the present invention is shown. As is described more fully in copending application Ser. No. 8/768,014 filed on Dec. 13, 1996, fuel injection is controlled by applying an electrical current in the form of the fuel injection signal to a two-way solenoid 15, which is attached to a pin 16 and biased toward a retracted position by a spring 17. The actuation fluid control valve also includes a ball valve member 55, and a spool valve member 60. Ball valve member 55 is positioned between a high pressure seat 56 and a low pressure seat 57. When solenoid 15 is deactivated, high pressure actuation fluid acting on ball valve member 55 holds the same in low pressure seat 57 to close actuation fluid drain 26. When solenoid 15 is activated, pin 16 moves downward contacting ball valve member 55 and pushing it downward to close high pressure seat 56 and open low pressure seat 57. By actuating the solenoid 15 and seating the ball valve member 55 in the high pressure seat 56, the injector begins to inject fuel. For a more detailed explanation of the preferred embodiment HEUI injector shown in FIG. 2, reference should be made to the above described co-pending U.S. patent application Ser. No. 8/768,014, which is attached hereto as Exhibit A and is incorporated herein as part of the present specification.

Again referring to FIG. 2, it can be seen that the response time of a HEUI fuel injector depends, in part, on the time required to move the ball valve member 55 from the low pressure seat 57 to the high pressure seat 56. In general, the response time is partly a function of the electrical current level of the fuel injection signal and primarily a function of the pull-in current duration time and the hydraulic force opposing the ball valve member 55.

The magnitude of the electrical current applied to solenoid 15 determines the force the solenoid 15 generates on the pin 16. To begin injecting fuel, the fuel injector current level must, be sufficient to overcome the opposing hydraulic force of the actuation fluid and sufficient to seat the ball valve member 55 in the high pressure seat 56. Further, the pull-in current duration time must be sufficient to hold the ball 55 to the high pressure seat 56 of the injector so that a lower current level can hold the ball 55 to the high pressure seat 56 for the remainder of the injection event. If the initial electrical current applied is too low, the solenoid 15 will generate insufficient force either to move the ball valve member 55 from the low pressure seat 57 or to seat the ball valve member 55 properly in the high pressure seat 56. Also, if the electrical current is applied for too short of a duration, the solenoid 15 will not be able to hold the ball 55 to the high pressure seat 56. In either case, the ball 55 will not remain properly seated when trying to use the lower current level to hold the ball 55 at the high pressure seat 56 for the hold-in current duration time which represents the remainder of the injection event. Therefore, the injector would not work properly.

On the other hand, if the current is too high, the solenoid 15 will generate too much force on the pin 16, which will thereby move the ball valve member 55 too quickly and cause the ball valve member 55 to impact the high pressure seat 56 with a greater force than desirable. This could cause the ball valve member 55 to bounce in the seat 56, thereby delaying the beginning of fuel injection, and because the delay caused by the bouncing is unpredictable, it would also introduce variability in the fuel injector response time. Furthermore, if the current is too high, it may create a force on the pin 16 which is large enough to cause an impact force of the ball valve member 55 on the seat 56 that could damage the pin 16 and thereby shorten the working life of the injector or cause the injector to malfunction. Similarly, if the pull-in current is too long of a duration, then the electronics must be able to provide greater power and dissipate the resulting heat.

To move the ball valve member 55 from the low pressure seat 57 to the high pressure seat 56, it is necessary to overcome the opposing force of the actuation fluid. The opposing force of the actuation fluid depends, in part, on: 1) the pressure of the fluid; and 2) the fluid viscosity (which in turn is a function of temperature). Thus, for a constant pull-in current applied to the solenoid, the response time will increase as: 1) the pressure of the actuation fluid increases; and 2) the temperature of the actuation fluid decreases. To maintain a relatively constant response time while reducing overall power requirements and minimizing the impact force generated by seating the ball valve member 55 in the high pressure seat 56, a preferred embodiment of the present invention varies the pull-in current duration time as a function of engine temperature. In a preferred embodiment, an engine temperature sensor is used to sense the temperature of the engine and use that measurement as an approximation of the fluid viscosity. In a preferred embodiment, it is possible to use either an engine oil temperature sensor or an engine coolant temperature sensor to determine engine temperature. Although a preferred embodiment of the present invention uses engine temperature, it should be recognized that in some applications it will be possible to modify the pull-in current duration time based on other parameters like actuating fluid viscosity without deviating from the scope of the present invention as defined by the appended claims.

Figure 3:
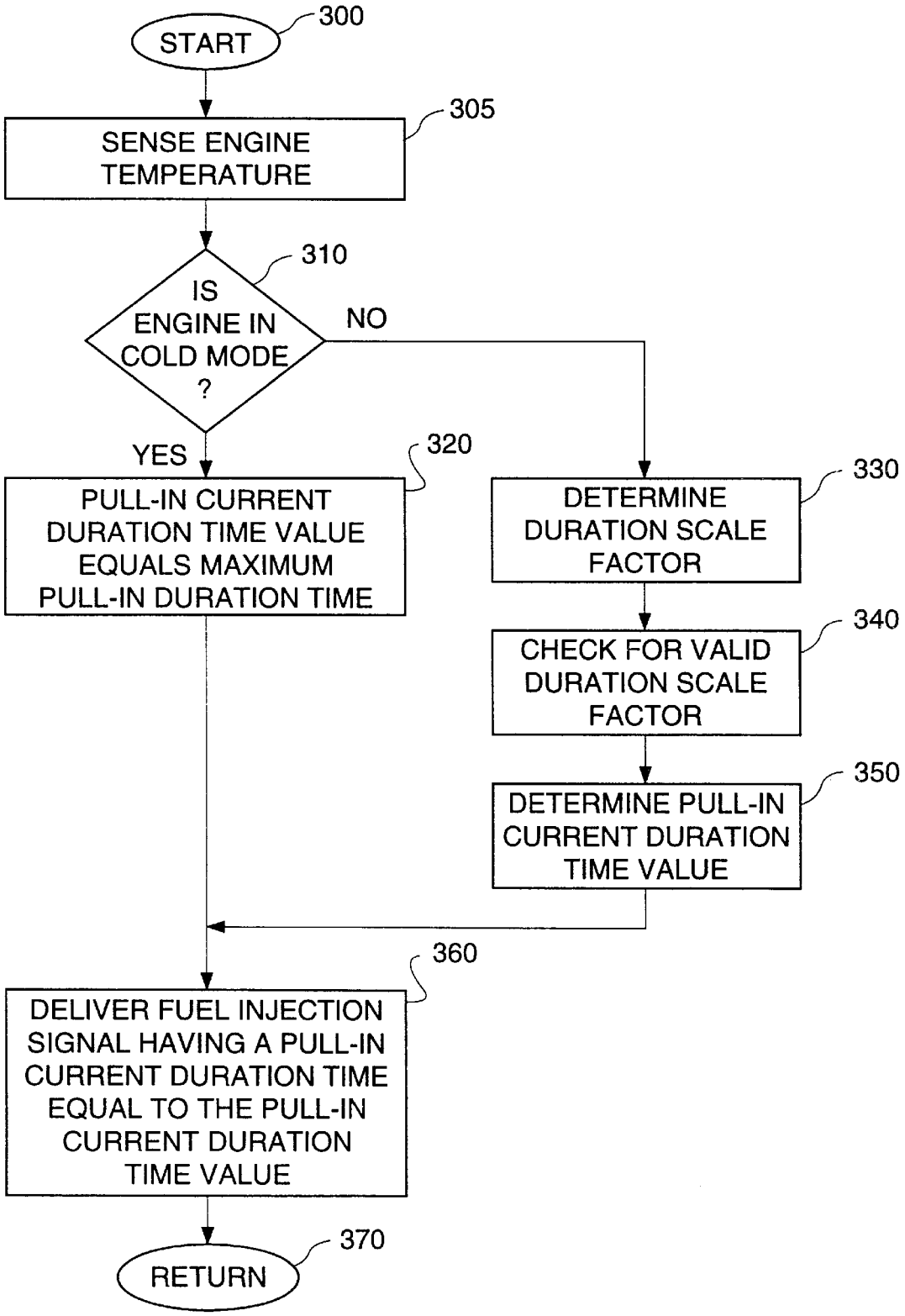
FIG. 3 is a flowchart of software logic implemented in a preferred embodiment.

Referring now to FIG. 3, a flowchart of the software logic used in connection with a preferred embodiment is shown. Those skilled in the art could readily and easily write software implementing the flowchart shown in FIG. 3 using the instruction set, or other appropriate language, associated with the particular microprocessor to be used. In a preferred embodiment, a Motorola MC68336 is used in the electronic controller 111. However, other known microprocessors could be readily and easily used without deviating from the scope of the present invention.

First block 300 begins the program control. Program control passes from first block 300 to second block 305. In second block 305, the electronic controller 111 reads a temperature signal produced by the engine temperature sensor 180. In a preferred embodiment, the engine temperature signal is an analog signal produced by a coolant temperature sensor or an engine oil temperature sensor, but could be based on another sensed temperature. The electronic controller 111 periodically inputs the engine temperature signal over input $S_1$ and stores the value in memory. In a preferred embodiment, the electronic controller 111 reads the engine temperature sensor once every eighth control loop and stores that value in memory. However, other sampling frequencies could be readily and easily used without deviating from the present invention as defined in the appended claims. In second block 305, the electronic controller 111 reads the memory location that stores the engine temperature value. Program control then passes to decision block 310.

In decision block 310, the electronic controller 111 determines whether the engine is in cold mode and stores the variable in memory. In a preferred embodiment, the electronic controller 111 reads the memory location that stores the cold mode variable. Cold mode is advantageously determined based on the engine temperature and other operating conditions like engine speed, suction temperature, discharge temperature and other conditions known by those skilled in the art. In a preferred embodiment, the controller 111 determines that the engine is not operating in cold mode if the engine temperature is greater than a predetermined cold mode temperature boundary value ($T_C$). Preferably, the predetermined cold mode temperature boundary value is eighteen degrees Celsius (18° C.). However, as is known to those skilled in the art, other values could be readily and easily used depending upon the properties of the actuating fluid provided to the HEUI without deviating from the present invention as defined by the appended claims. If the engine is determined to be in cold mode, then program control passes to fourth block 320. Otherwise, program control passes to fifth block 330.

In fourth block 320, the electronic controller 111 sets the pull-in current duration time value ($T_P$) equal to the maximum pull-in duration time ($T_T$) . The maximum pull-in duration time ($T_T$) is preferably stored in memory and read by the electronic controller 111. Further, the maximum pull-in duration time ($T_T$) could be as long as the total injection duration time. However, the maximum pull-in duration time ($T_T$) is preferably less than the total injection duration time. In a preferred embodiment, the maximum pull-in duration time ($T_T$) is approximately two milliseconds (2 ms). From fourth block 320, program control passes to eighth block 360.

Referring back to fifth block 330, the duration scale factor ($F_S$) is determined by the electronic controller 111. In a preferred embodiment, the electronic controller 111 calculates the duration scale factor ($F_S$) according to the following equation:

$$F_S=(T_F-T_E)/(T_F-T_C);$$

wherein:

$T_F$=fluid temperature boundary value $T_E$=temperature of the engine $T_C$=predetermined cold mode temperature boundary value. The fluid temperature boundary value ($T_F$) represents the temperature where the effect of the viscosity of the oil on the action of the injector is negligible. Preferably, the fluid temperature boundary value ($T_F$) is thirty-five degrees centigrade (35° C.). From fifth block 330, program control passes to sixth block 340.

In sixth block 340, the electronic controller ill verifies that the duration scale factor ($F_S$) calculated in fifth block 330 is valid. 10 Preferably, the electronic controller verifies that the duration scale factor ($F_S$) is greater than zero and less than one ($0<F_S<1$). From sixth block 340, program control passes to seventh block 350.

In seventh block 350, the electronic controller 111 calculates a pull-in current duration time value ($T_P$). In a preferred embodiment, the electronic controller 111 calculates a pull-in current duration time value ($T_P$) according to the following equation:

$$T_P=T_D+F_S(T_T-T_D);$$

wherein:

$T_D$=default pull-in duration time $T_T$=predetermined maximum pull-in duration time.

Preferably, the default pull-in duration time ($T_D$) is no longer than is required to provide the desired response in the least severe operating conditions. The maximum pull-in duration time ($T_T$) is the maximum period that the pull-in current levels must be sustained under the most severe operating conditions, preferably two milliseconds (2 ms). However, as is known to those skilled in the art, different values for the default pull-in duration time ($T_D$) and the maximum pull-in duration time ($T_T$) could be used depending upon the engine operating conditions and design specifications of the particular engine and without deviating from the inventions as defined by the appended claims. From seventh block 350, program control passes to eighth block 360.

In eighth block 360, the electronic controller 111 delivers a fuel injection signal having a pull-in current duration time equal to the pull-in current duration time value ($T_P$). From eighth block 360, program control passes to ninth block 370.

In block 370, program control returns to the main program where the electronic controller 111 uses the pull-in current duration time determined in block 360 to develop the injection signal delivered to the injectors over the control line $S_{10}$. The logic of FIG. 3 is performed every control loop to help insure that the pull-in current duration time is as close as possible to the pull-in duration time actually required to produce the expected fuel injector response time. However, those skilled in the art know that the pull-in current duration could be determined at other frequencies depending on factors like the rate of change of the engine temperature without deviating from the invention as defined by the appended claims.

Figure 4:
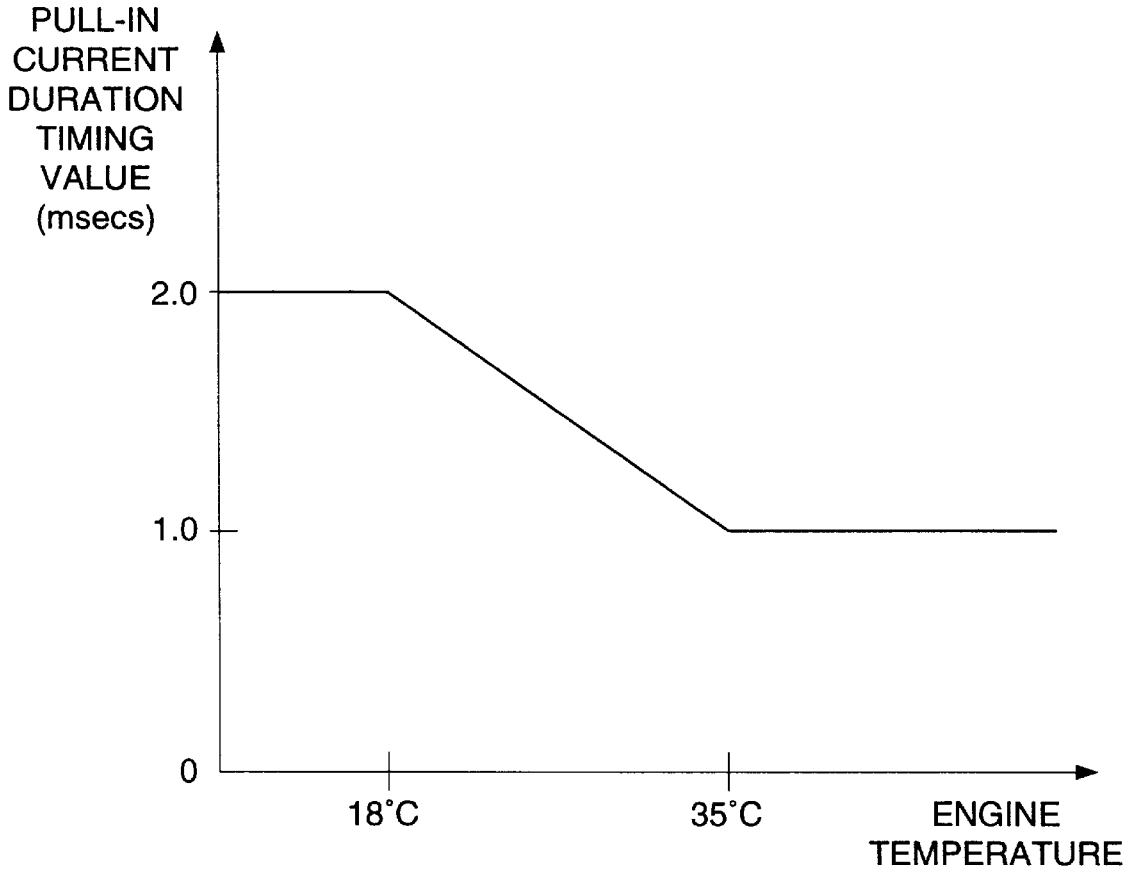
FIG. 4 is a generic map of the type used in connection with an embodiment of the present invention.

Referring now to FIG. 4 a generic graphical map of the type that is used in an embodiment of the invention is shown. The map is a graphical representation of a look-up table that could be stored in memory and used by the electronic controller 111 to determine the pull-in current duration time value ($T_P$) instead of the steps shown in fifth, sixth, and seventh blocks 330, 340, and 350, respectfully. As can be seen in the figure, as the engine temperature increases, the pull-in current duration time required to move and hold the ball valve member 55 from the low pressure seat 57 to the high pressure seat 56 decreases. This results from the actuation fluid's viscosity decreasing as the engine temperature increases. Therefore, the duration of the pull-in current required to overcome the force of the actuation fluid decreases as the temperature increases. The specific values in a look-up table and on the corresponding map are a function of the specific injector, the specific actuation fluid, and the engine used, among other factors. Although FIG. 4 represents the preferred map of pull-in current duration time values used in connection with an embodiment of the HEUI injector shown in FIG. 2, the present invention is not limited to that specific table nor to those specific pull-in current duration time values. To the contrary, it is expected that the pull-in current duration time values may be different for different fuel injectors and actuation fluids, among other factors. The use of pull-in current duration time values different than those shown in FIG. 4 would nevertheless fall within the scope of the present invention as defined by the appended claims.

While aspects of the present invention have been particularly shown and described with reference to the preferred embodiment above, it will be understood by those skilled in the art that various additional embodiments may be contemplated without departing from the spirit and scope of the present invention. For example, a method or apparatus of the present invention may use more than one map or a combination of a map(s) and logic functions like comparators or limitors to determine the pull-in duration time or pull-in duration time values. However, such a device or method should be understood to fall within the scope of the present invention as determined based upon the claims below and any equivalents thereof.

Other aspects, objects and advantages of the present invention can be obtained from a study of the drawings, the disclosure and the appended claims.

We claim:

1. An electronic control system for use with a compression ignition engine having a hydraulically actuated electronic unit fuel injector, said electronic control system comprising:

an electronic controller electrically connected to said hydraulically actuated electronic unit fuel injector;

an engine temperature sensor producing a signal responsive to a temperature of said engine and communicating the signal responsive to a temperature of said engine to the controller; and wherein said electronic controller delivers a fuel injection signal to said hydraulically actuated electronic unit fuel injector, said fuel injection signal including a pull-in current duration time and a hold-in current duration time, said pull-in current duration time being a function of said signal responsive to the temperature of the engine.

2. The electronic control system of claim 1, including a memory device associated with said electronic controller, said memory device having a map stored therein correlating a specific value of the signal responsive to the temperature of the engine to an engine pull-in current duration time value.

3. The electronic control system of claim 2, including an engine speed sensor associated with said engine, said engine speed sensor electrically connected to said electronic controller and producing an engine speed signal responsive to the speed of said engine and wherein said electronic controller delivers a fuel injection signal to said hydraulically actuated electronic unit fuel injector as a function of said engine speed signal and said signal responsive to the temperature of the engine.

4. The electronic control system of claim 1, including a memory device associated with said electronic controller, said memory device having a maximum pull-in duration time ($T_T$) and default pull-in duration time ($T_D$) stored therein and wherein the electronic controller determines a duration scale factor ($F_S$) as a function of said signal responsive to the temperature of the engine and calculates a pull-in current duration time value ($T_P$) according to the following equation:

$$T_P=T_D+F_S(T_T-T_D).$$

5. The electronic control system of claim 4, said memory device having a predetermined cold mode temperature boundary value ($T_C$) and fluid temperature boundary value ($T_F$) stored therein and wherein the electronic controller determines a specific value of the signal responsive to the temperature of the engine ($T_E$) and calculates the duration scale factor ($F_S$) according to the following equation:

$$F_S=(T_F-T_E)/(T_F-T_C).$$

6. The electronic control system of claim 4, including an engine speed sensor associated with said engine, said engine speed sensor electrically connected to said electronic controller and producing an engine speed signal responsive to the speed of said engine and wherein said electronic controller delivers a fuel injection signal to said hydraulically actuated electronic unit fuel injector as a function of said engine speed signal and said signal responsive to the temperature of the engine.

7. An electronic control system for use with a compression ignition engine having a hydraulically actuated electronic unit fuel injector, said electronic control system comprising:

an electronic controller electrically connected to said hydraulically actuated electronic unit fuel injector;

an engine temperature sensor producing a signal responsive to a temperature of said engine;

a memory device associated with said electronic controller, said memory device having a map stored therein correlating a specific value of the signal responsive to the temperature of the engine to an engine pull-in current duration time value; and wherein said electronic controller delivers a fuel injection signal having a pull-in current duration time and a hold-in current duration time to said hydraulically actuated electronic unit fuel injector as a function of said temperature signal, said pull-in current duration time varies in duration in response to said signal responsive to a temperature of said engine.

8. The electronic control system of claim 7, including an engine speed sensor associated with said engine, said engine speed sensor electrically connected to said electronic controller and producing an engine speed signal responsive to the speed of said engine and wherein said electronic controller delivers a fuel injection signal to said hydraulically actuated electronic unit fuel injector, said fuel injection signal varies in response to said engine speed signal and said signal responsive to the temperature of the engine.

9. A method of controlling fuel delivery to a compression ignition engine having an electronic controller, a hydraulically actuated electronically controlled fuel injector and an engine temperature sensor, said method comprising:

sensing a temperature of said engine;

determining a fuel injection signal as a function of said step of sensing; and delivering said fuel injection signal to said hydraulically actuated electronically controlled fuel injector, said fuel injection signal including a pull-in current duration time and a hold-in current duration time, wherein said pull-in current duration time is a function of said signal responsive to the temperature of the engine.

* * * * *